US006758653B2

(12) United States Patent
Morrison

(10) Patent No.: US 6,758,653 B2
(45) Date of Patent: Jul. 6, 2004

(54) CERAMIC MATRIX COMPOSITE COMPONENT FOR A GAS TURBINE ENGINE

(75) Inventor: Jay Morrison, Oviedo, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 39 days.

(21) Appl. No.: 10/237,769

(22) Filed: Sep. 9, 2002

(65) Prior Publication Data

US 2004/0047726 A1 Mar. 11, 2004

(51) Int. Cl.[7] ..... F01D 11/12

(52) U.S. Cl. ..... 415/173.4; 415/200; 415/174.4; 415/116

(58) Field of Search ..... 415/173.4, 173.5, 415/174.4, 213.1, 200, 116; 277/247

(56) References Cited

U.S. PATENT DOCUMENTS 4,318,666 A * 3/1982 Pask ..... 415/116
4,422,648 A 12/1983 Eaton et al.
4,646,810 A 3/1987 Lardellier
4,679,981 A 7/1987 Guibert et al.
4,704,332 A * 11/1987 Brennan et al. ..... 415/174.4
4,759,687 A * 7/1988 Miraucourt et al. ..... 415/209.3
4,907,411 A 3/1990 Krueger
5,027,604 A 7/1991 Krueger
5,080,557 A 1/1992 Berger
5,304,031 A * 4/1994 Bose ..... 415/200
5,363,643 A 11/1994 Halila
6,089,821 A 7/2000 Maguire et al.
6,197,424 B1 3/2001 Morrison et al.
6,435,824 B1 * 8/2002 Schell et al. ..... 415/174.4

* cited by examiner

*Primary Examiner*—Edward K. Look
*Assistant Examiner*—Igor Kershteyn

(57) ABSTRACT

A ceramic matrix composite (CMC) component for a combustion turbine engine (10). A blade shroud assembly (30) may be formed to include a CMC member (32) supported from a metal support member (32). The CMC member includes arcuate portions (50, 52) shaped to surround extending portions (46, 48) of the support member to insulate the metal support member from hot combustion gas (16). The use of a low thermal conductivity CMC material allows the metal support member to be in direct contact with the CMC material. The gap (42) between the CMC member and the support member is kept purposefully small to limit the stress developed in the CMC member when it is deflected against the support member by the force of a rubbing blade tip (14). Changes in the gap dimension resulting from differential thermal growth may be regulated by selecting an angle (A) of a tapered slot (76) defined by the arcuate portion.

21 Claims, 2 Drawing Sheets

CERAMIC MATRIX COMPOSITE COMPONENT FOR A GAS TURBINE ENGINE

FIELD OF THE INVENTION

This invention relates generally to the field of combustion turbine engines and more particularly to the use of ceramic matrix composite materials in a combustion turbine engine.

BACKGROUND OF THE INVENTION

U.S. Pat. No. 6,197,424 describes a ceramic insulating material that may be applied to a ceramic matrix composite (CMC) material for use in high temperature applications such as a gas turbine engine. That patent illustrates several components of a gas turbine engine utilizing the insulated CMC material, however, that patent does not describe how the insulated CMC material may be secured to the metal casing of the gas turbine engine.

U.S. Pat. No. 4,759,687 illustrates the use of a ceramic composition for a turbine ring application. The method of attachment described in this patent disadvantageously results in portions of the metal structure of the turbine ring remaining exposed to the hot combustion gasses.

Ceramic coatings are often applied directly to metal components to increase the high temperature performance characteristics of the components. The differential thermal expansion characteristics of metal and ceramic presents a design challenge for such coatings, as discussed in U.S. Pat. No. 5,080,557.

U.S. Pat. No. 4,679,981 describes an arrangement for clamping an abradable ceramic turbine blade ring so that there is always a compressive force on the ring. This arrangement relies on the differential cooling of the underlying metal carrier and it purposefully provides no cooling for the ceramic material. The safe operating temperature of the ceramic material would thus limit applications of this design.

U.S. Pat. No. 5,363,643 describes a ceramic combustor liner for a gas turbine engine. A plurality of individual ceramic liner segments is rigidly attached with a bolt and nut combination to an outer frame to form the cylindrical combustor shape. Each liner segment is carried by the outer frame and moves therewith as the frame expands and contracts, thereby mitigating the stresses experienced by the individual segments. This design necessitates the use of a large number of individual segments, which in turn results in a large number of joints where leakage of cooling air may occur. Such air leakage has a detrimental impact on engine efficiency and should be minimized. Furthermore, the use of small fasteners inside a gas turbine engine is generally undesirable.

U.S. Pat. No. 4,907,411 describes the use of sheet metal mounting members to support ceramic combustion chamber segments. The sheet metal members are used to space the ceramic segments relative to a housing, but they offer no structural support for the ceramic segments. As such, this attachment arrangement would be of limited value in applications where mechanical loads may be imposed upon the ceramic material, such as in a turbine shroud ring application where a ceramic ring segment may be exposed to impact with rotating turbine blades. Furthermore, this design requires the placement of a thermally insulating material between the sheet metal members and the ceramic combustion chamber segments. The ceramic material in this design is a non-oxide material such as silicon carbide or silicon nitride that is relatively very conductive to heat (10–20 watts/meter-° K). This design allows the ceramic material to operate at a high temperature, and it provides protection to the metal members through the use of the insulating sealing strip between the metal and the ceramic, a layer of thermally reflective material on the side of the metal that faces the ceramic, and a small flow of cooling fluid between the metal and the ceramic surfaces.

SUMMARY OF THE INVENTION

Thus, improved manners of attaching a ceramic matrix composite material to a turbine casing are needed to provide thermal protection to metal parts, to eliminate the need for small fasteners and intervening insulating members, and to provide mechanical support for applications where mechanical loads are imposed onto the CMC material.

A component for use in a combustion turbine engine is described herein as including: a metal support member supported within a casing of a gas turbine engine and further comprising an extending portion; a ceramic matrix composite member shielding the metal support member from a combustion gas flowing within the combustion turbine engine during operation of the combustion turbine engine and comprising an arcuate portion extending around and in direct contact with the extending portion of the metal support member for supporting the ceramic matrix composite member from the metal support member; and the ceramic matrix composite member selected to have a thermal conductivity characteristic that is sufficiently low to maintain the support member below a predetermined temperature during operation of the combustion turbine engine. The ceramic matrix composite member may be separated from the metal support member by a gap having a predetermined maximum dimension at a location remote from the arcuate portion, the predetermined maximum dimension selected to control a level of stress developed in the shroud member when the ceramic matrix composite member is deflected to reduce the gap to zero.

A blade shroud assembly for a combustion turbine engine is described herein as including: a metal support member supported within a combustion turbine engine and comprising an upstream edge and an opposed downstream edge each extending along a circumferential length; a ceramic matrix composite shroud member comprising an upstream portion and an opposed downstream portion each extending along a circumferential length and each having an arcuate shape defining an upstream slot and a downstream slot receiving and in direct contact with respectively the upstream edge and the downstream edge of the support member for supporting the support member and for shielding the shroud member from a combustion gas flowing within the combustion turbine engine; and a layer of an abradable material disposed on a radially inner surface of the ceramic matrix composite shroud member for abradable wear against a rotating blade tip of the combustion turbine engine; the layer of abradable material and the ceramic matrix composite shroud member providing a degree of thermal insulation sufficient to maintain the metal support member below a predetermined temperature at respective points of direct contact between the ceramic matrix composite shroud member and the metal support member during operation of the combustion turbine engine. The blade shroud assembly may further include: a radially inner surface of the support member and a radially outer surface of the shroud member having respective closest points separated by a gap having a predetermined dimension; wherein a predetermined maximum dimension of the gap is selected so that a predetermined level of stress in the shroud member is not exceeded when the radially outer surface of the shroud member is deflected radially outwardly by the rotating blade tip to make contact with the radially inner surface of the support member.

A shroud assembly for sealing a cavity extending radially outward from a rotating blade tip to a blade ring of a combustion turbine engine to isolate the cavity from a combustion gas flowing past the blade tip is describe herein as including: a ceramic matrix composite member comprising a radially inner surface for wearing contact with the rotating blade tip and defining a primary pressure boundary for the combustion gas, the ceramic matrix composite member further comprising an arcuate portion defining a slot; a metal support member attached to a blade ring of the combustion turbine engine and comprising a radially outer surface separated from the radially inner surface by a gap and further comprising a portion extending into the slot for supporting the ceramic matrix composite member within the combustion turbine engine, the radially inner surface defining a secondary pressure boundary for the combustion gas in the event of failure of the ceramic matrix composite member; and the gap having a dimension sufficiently small to limit resonance of fluid surrounding the rotating blade tip in the event of failure of the ceramic matrix composite member. The gap may have a maximum dimension selected to control a level of stress developed in the ceramic matrix composite member when the ceramic matrix composite member is impacted by the rotating blade tip. The metal support member is selected to provide a predetermined resistance to further deflection of the ceramic matrix composite member when the ceramic matrix composite member is deflected to reduce the gap to zero.

BRIEF DESCRIPTION OF THE DRAWINGS

These and other advantages of the invention will be more apparent from the following description in view of the drawings that show.

DETAILED DESCRIPTION OF THE INVENTION

Figure 1:
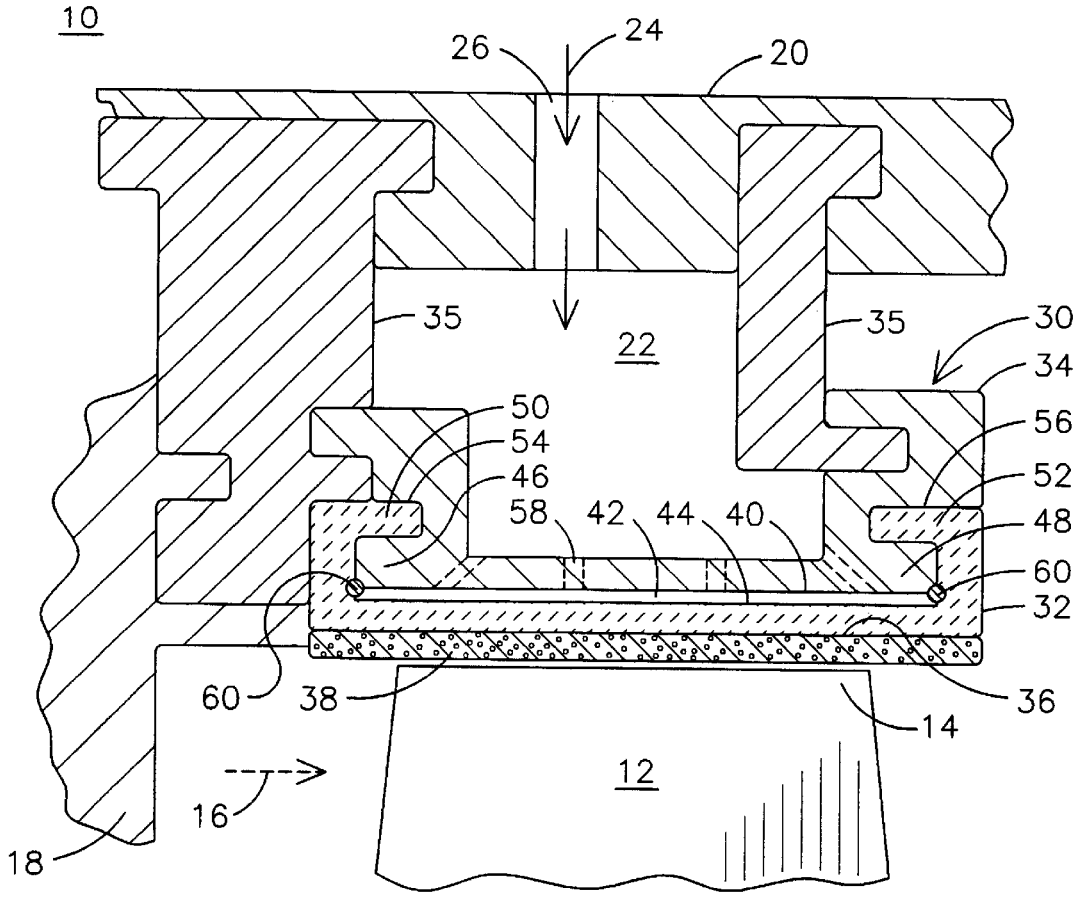
FIG. 1 is a partial cross-sectional view of a combustion turbine engine including a ceramic matrix composite blade ring.

A portion of a combustion turbine engine 10 is illustrated in a partial cross-sectional view of FIG. 1. A rotating blade 12 has a tip portion 14 disposed in a stream of hot combustion gas 16 flowing over the blade 12 and an adjacent stationary vane 18 generally in the direction of the arrow during operation of the combustion turbine engine 10. A blade ring 20 attached to a casing (not shown) of the combustion turbine engine 10 defines a cavity 22 extending radially outward from the rotating blade tip 14 to the blade ring 20. A cooling fluid 24 such as steam or compressed air enters cavity 22 through an opening 26 formed in blade ring 20.

Combustion turbine 10 includes a shroud assembly 30 for isolating cavity 22 from the combustion gas 16. The shroud assembly includes a ceramic matrix composite (CMC) member 32 and a metal support member 34. CMC member 32 includes a radially inner surface 36 defining a primary pressure boundary for the combustion gas 16. The radially inner surface 36 may be coated with a layer of an abradable material 38, for example the abradable insulating material described in U.S. Pat. No. 6,197,424. The radially inner surface 36 with or without the layer of abradable material 38 is positioned proximate the blade tip 14 against which it may experience a degree of abradable wear. Some degree of abrasion is tolerated in an attempt to minimize the amount of combustion gas 16 that passes around the blade tip 14 without passing over the blade 12. The CMC member 32 may be formed of a ceramic oxide material, for example mullite or alumina, or it may be formed of any ceramic material having a low heat transfer characteristic, such as no more than 4 watts/meter-° K at the component operating temperature for example.

CMC member 32 is supported within the combustion turbine engine 10 by support member 34, which in turn is supported directly or indirectly from the blade ring 20 or casing (not shown) of the combustion turbine 10. In FIG. 1 the support member 34 is connected to isolation rings 35 which are, in turn, connected directly to the blade ring 20. Support member 34 may be formed of metal of any alloy having suitable properties for the particular application. Support member 34 includes a radially inner surface 40 separated by a gap 42 from a radially outer surface 44 of the CMC member 32. Support member 34 also includes an upstream extending portion 46 and an opposed downstream extending portion 48, so named to reflect the general direction toward which they project.

CMC member 32 includes an upstream arcuate portion 50 and an opposed downstream arcuate portion 52. These structures define slots 54, 56 for receiving the respective upstream and downstream extending portions 46, 48 for supporting the CMC member 32 within the combustion turbine engine 10. An anti-rotation device such as a pin (not shown) may also be installed between the CMC member 32 and the support member 34 to provide further support there between. Arcuate portions 50, 52 are illustrated in FIG. 1 as having a generally C-shaped cross-section, although other shapes may be used in other applications provided that the arcuate portion extends a sufficient length to wrap around the extending portion 46, 48 to provide mechanical support as well as to shield the metal support member 34 from the hot combustion gas 16.

One or a plurality of cooling passages 58 may be formed in support member 34 to permit a portion of the cooling fluid 24 to pass into the gap 44 to provide cooling for CMC member 32. Sealing members such as O-ring seal 60 may be provided to direct the flow of the cooling fluid 24. The size of the opening 26, and cooling passages 58 and the pressure of the cooling fluid 24 may be selected to provide a desired flow rate of cooling fluid 24 through the gap 42. The temperature of the metal support member 34 is maintained below a desired upper limit as a result of the combination of the insulating action of coating 38 and CMC member 32 and the active cooling provided by cooling fluid 26. The thermal conductivity characteristic of the CMC member 32, as well as that of any overlying insulating material, is selected to be sufficiently low to maintain the support member 34 below a predetermined temperature during operation of the combustion turbine engine 10 so that it is possible to provide direct contact between the CMC member 32 and the metal support member 34 without the need for any intervening thermal insulating material. Such contact will occur at least along portions of the mating surfaces of the arcuate portion 50, 52 and the extending portions 46, 48.

It is expected that blade tip 14 may on occasion make contact with the layer of abradable material 38, thereby imposing a mechanical force into CMC member 32. From a design perspective, CMC member 32 must be able to absorb such force without failure. The shroud assembly 30 of FIG. 1 accommodates such rubbing forces by allowing such force to be transferred to the metal support member 34. This is accomplished by controlling the maximum allowable dimension for gap 42 so that when blade tip 14 rubs against the shroud assembly 30, the CMC member 32 will deflect to reduce the gap to zero in at least one location opposed the blade 12 and remote from the arcuate portions 50, 52 so that the radially inner surface 40 of support member 34 provides support against the radially outer surface 44 of the CMC member 32. The support member 34 is designed to provide a predetermined resistance to further deflection of the CMC member 32 once the gap 42 is reduced to zero, thereby limiting the peak stress in the CMC member 32. The maximum dimension of gap 42 is selected to control the level of stress developed in the shroud member 30, in particular in the arcuate portions 50, 52 of CMC member 32 as the CMC member 32 deflects during a rubbing event.

If a shroud assembly of a combustion turbine fails, there is an increased likelihood of damage to or failure of the rotating blades 12 as a result of resonance developed within the cavity 22. The shroud assembly 30 of FIG. 1 provides additional protection against such damage by positioning the metal support member 52 radially outwardly from CMC member 32 and in close proximity thereto. In the unlikely event that the CMC material should fail, the metal support member 34 provides a secondary pressure boundary for the combustion gas 16 and thereby limits the opportunity for the development of resonance of the fluid surrounding the blade tip 14.

Figure 2:
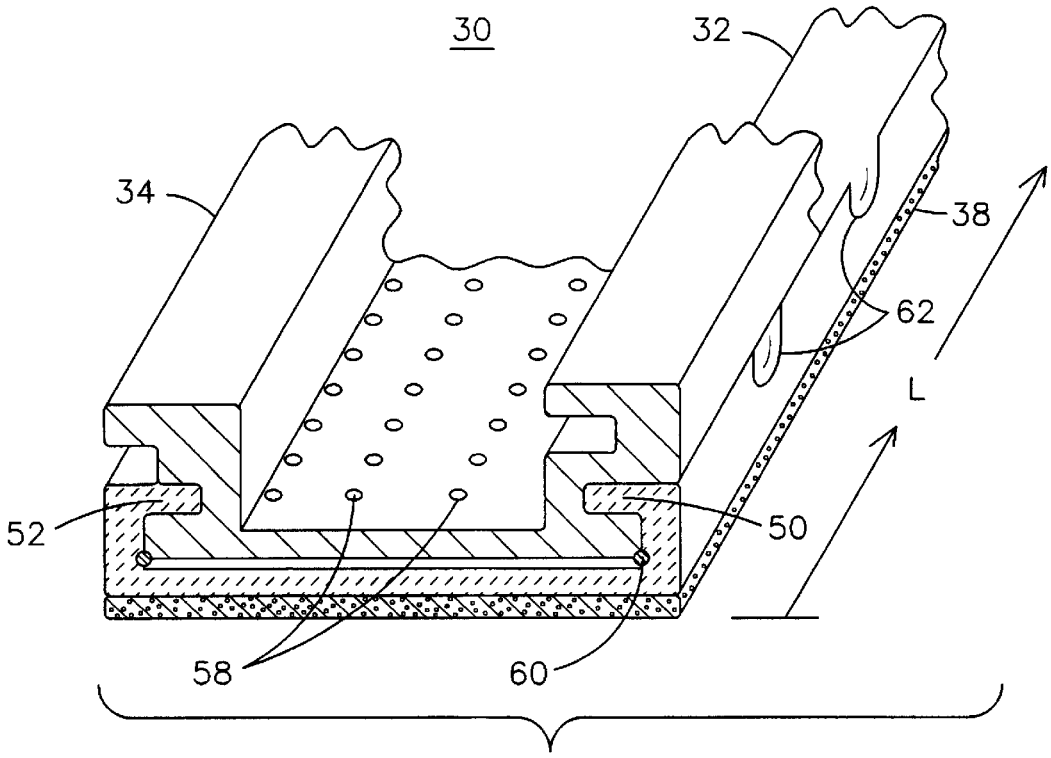
FIG. 2 is a perspective view of a portion of the blade ring of FIG. 1.

FIG. 2 is a perspective view of shroud assembly 30 illustrating a portion of its circumferential length L. It is desired to form the shroud assembly to have as large a circumferential length as practical in order to minimize the number of segments needed to form a complete 360° shroud assembly. Typically, the circumferential length is limited by stresses that are developed in the component due to differential thermal expansion as the combustion turbine 10 cycles through various temperature regiments. In order to relieve the hoop stresses that may be formed in CMC member 32, one or more grooves 62 are formed in the arcuate portion 50, 52 along its circumferential length. Furthermore, while the coefficient of thermal expansion of metal is typically much higher than that of a ceramic matrix composite material, the relative differential thermal growth of the CMC member 32 and the metal support member 34 is limited by the fact that the changes in temperature of the support member 34 are much less than the changes in temperature of the CMC member 32. Thus, the shroud assembly 30 of FIG. 1 may be formed to have a circumferential length L that is significantly longer than those of prior art shroud assemblies. For example, a typical prior art combustion turbine engine may have 32–48 shroud segments forming a full 360° circumference, whereas the combustion turbine 10 of the present invention may require only 8–24 segments to form the full circumference. Note that the joints between adjoining segments of the metal support member 34 and those between the adjoining segments of the CMC member 32 may be purposefully placed in different circumferential positions to further minimize the leakage of cooling fluid 24.

Figure 3:
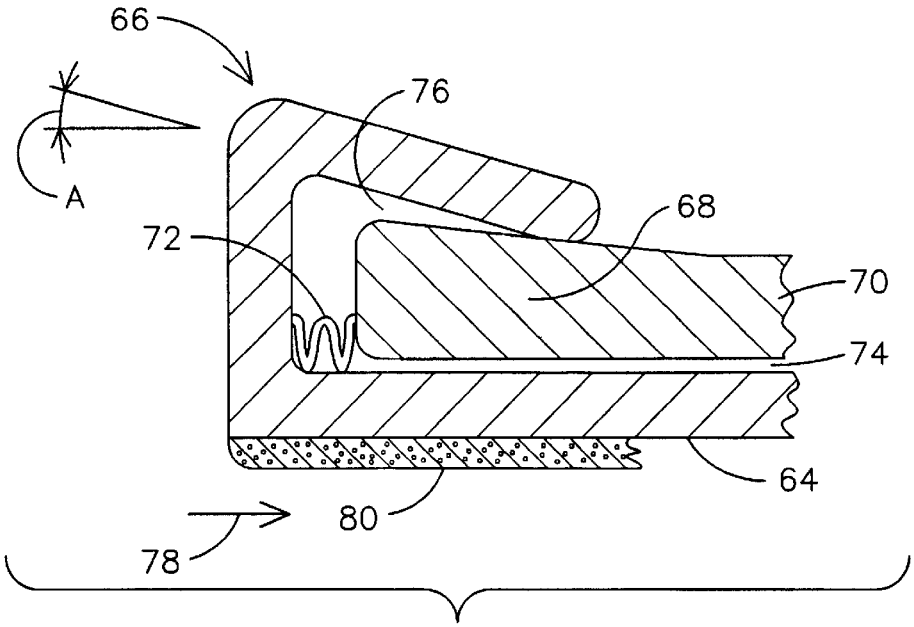
FIG. 3 is a partial cross-sectional view of an area of contact between a ceramic matrix composite blade ring and a metal support member.

FIG. 3 illustrates a close-up view of the area of contact between a ceramic matrix composite blade ring and a metal support member. A CMC member 64 includes an arcuate portion 66 extending around an extending portion 68 of a metal support member 70. A sealing member in the form of a W-seal 72 is disposed between the CMC member 64 and support member 70 across gap 74. Note that in this embodiment, the arcuate portion 66 forms a slot 76 having a tapered opening defined by an angle A. As the radial thickness (vertical axis of FIG. 3) and axial length (horizontal axis of FIG. 3) of the support member 70 change due to thermal growth; the position of extending portion 68 within the slot 76 will change, thereby affecting the size of gap 74. However, it is possible to regulate the impact of temperature changes on the dimension of gap 74 by selecting angle A so that the effects of thermal growth in the axial and radial directions are at least partially counteracting. The ratio of the changes in the radial and axial dimensions of support member 70 will equal the ratio of the overall radial and axial dimensions assuming that the support member 70 is at approximately the same temperature along its width. For the geometry illustrated in FIG. 3, the change in the dimension of gap 74 can be minimized by selecting angle A to be equal to the arctangent of the ratio of the radial and axial dimensions of the support member 30. The control of the dimension of gap 74 has important effects on the level stress developed in the arcuate portion 66 of CMC member 64, on the velocity of cooling air through the gap 74, and on the location of the arcuate inner surface 80 relative to a rotating blade tip for controlling the leakage of combustion gas 78 around the blade tip. In one embodiment it may be desired to provide the gap 74 with a non-zero dimension during a cold shutdown condition of the combustion turbine engine 10 and to have the gap 74 reduced to zero under predetermined operating conditions of the engine 10.

While the preferred embodiments of the present invention have been shown and described herein, it will be obvious that such embodiments are provided by way of example only. Numerous variations, changes and substitutions will occur to those of skill in the art without departing from the invention herein. For example, while FIGS. 1–3 illustrate the application of a CMC blade shroud assembly, other applications of CMC material may be envisioned using the principles described herein, for example in a combustor liner having a CMC member backed by a metal support member. Accordingly, it is intended that the invention be limited only by the spirit and scope of the appended claims.

I claim as my invention:

1. A component for use in a combustion turbine engine, the component comprising:

a metal support member supported within a casing of a gas turbine engine and further comprising an extending portion;

a ceramic matrix composite member shielding the metal support member from a combustion gas flowing within the combustion turbine engine during operation of the combustion turbine engine and comprising an arcuate portion extending around and in direct contact with the extending portion of the metal support member for supporting the ceramic matrix composite member from the metal support member; and the ceramic matrix composite member selected to have a thermal conductivity characteristic that is sufficiently low to maintain the support member below a predetermined temperature during operation of the combustion turbine engine;

further comprising the ceramic matrix composite member being separated from the metal support member by a gap having a predetermined maximum dimension at a location remote from the arcuate portion, the predetermined maximum dimension selected to control a level of stress developed in the shroud member when the ceramic matrix composite member is deflected to reduce the gap to zero.

2. The component of claim 1, wherein the ceramic matrix composite member comprises a ceramic oxide material.

3. The component of claim 1, wherein the ceramic matrix composite member further comprises a layer of ceramic matrix composite material coated with a layer of an abradable material.

4. The component of claim 3, wherein the layer of abradable material comprises an arcuate surface proximate a path of a rotating blade tip of the combustion turbine engine for controlling a flow of the combustion gas proximate the blade tip.

5. The component of claim 1, further comprising:

the arcuate portion defining a slot having a tapered opening;

the extending portion extending into the tapered opening to a position dependant upon relative temperatures of the ceramic matrix composite member and the metal support member as a result of differential thermal expansion between the ceramic matrix composite member and the metal support member; and an angle of the tapered opening selected to provide a predetermined change in the gap as a result of change in position of the extending portion within the slot.

6. The component of claim 5, wherein the metal support member is selected to provide a predetermined resistance to further deflection of the ceramic matrix composite member when the ceramic matrix composite member is deflected to reduce the gap to zero.

7. The component of claim 5, further comprising a cooling passage formed in the metal support member for passing a cooling fluid into the gap.

8. The component of claim 7, further comprising a seal between the ceramic matrix composite member and the support member for directing the passage of the cooling fluid.

9. The component of claim 1, wherein the arcuate portion extends to have a circumferential length, and further comprising a groove formed in the arcuate portion at a predetermined location along the circumferential length to limit a level of stress in the ceramic matrix composite member.

10. A blade shroud assembly for a combustion turbine engine comprising:

a metal support member supported within a combustion turbine engine and comprising an upstream edge and an opposed downstream edge each extending along a circumferential length;

a ceramic matrix composite shroud member comprising an upstream portion and an opposed downstream portion each extending along a circumferential length and each having an arcuate shape defining an upstream slot and a downstream slot receiving and in direct contact with respectively the upstream edge and the downstream edge of the support member for supporting the shroud member and for shielding the support member from a combustion gas flowing within the combustion turbine engine;

a layer of an abradable material disposed on a radially inner surface of the ceramic matrix composite shroud member for abradable wear against a rotating blade tip of the combustion turbine engine;

the layer of abradable material and the ceramic matrix composite shroud member providing a degree of thermal insulation sufficient to maintain the metal support member below a predetermined temperature at respective points of direct contact between the ceramic matrix composite shroud member and the metal support member during operation of the combustion turbine engine; and a radially inner surface of the support member and a radially outer surface of the shroud member having respective closest points separated by a gap having a predetermined dimension;

wherein a predetermined maximum dimension of the gap is selected so that a predetermined level of stress in the shroud member is not exceeded when the radially outer surface of the shroud member is deflected radially outwardly by the rotating blade tip to make contact with the radially inner surface of the support member.

11. The blade shroud assembly of claim 10, wherein the gap has a non-zero dimension during a cold shutdown condition of the combustion turbine engine and the gap is reduced to zero under predetermined operating conditions of the combustion turbine engine.

12. The blade shroud assembly of claim 10, further comprising:

each of the upstream slot and downstream slot comprising a tapered opening;

the upstream edge and the downstream edge extending into the respective tapered opening to a respective position dependant upon relative temperatures of the ceramic matrix composite shroud member and the metal support member as a result of differential thermal expansion between the ceramic matrix composite shroud member and the metal support member; and an angle of each respective tapered opening selected to provide a predetermined change in the gap as a result of a change in position of the respective edge in the tapered opening.

13. The blade shroud assembly of claim 10, further comprising a stress relief notch formed in a radially outward portion of at least one of the upstream and downstream portions of the shroud member at a predetermined location along the circumferential length.

14. The blade shroud assembly of claim 10, further comprising at least one coolant passage formed in the support member for passing a flow of a cooling fluid to make contact with the shroud member.

15. A shroud assembly for sealing a cavity extending radially outward from a rotating blade tip to a blade ring of a combustion turbine engine to isolate the cavity from a combustion gas flowing past the blade tip, the shroud assembly comprising:

a ceramic matrix composite member comprising a radially inner surface for wearing contact with the rotating blade tip and defining a primary pressure boundary for the combustion gas, the ceramic matrix composite member further comprising an arcuate portion defining a slot;

a metal support member attached to a blade ring of the combustion turbine engine and comprising a radially inner surface separated from a radially outer surface of the ceramic matrix composite member by a gap and further comprising a portion extending into the slot for supporting the ceramic matrix composite member within the combustion turbine engine, the radially inner surface of the metal support member defining a secondary pressure boundary for the combustion gas in the event of failure of the ceramic matrix composite member; and the gap having a dimension sufficiently small to limit resonance of fluid surrounding the rotating blade tip in the event of failure of the ceramic matrix composite member.

16. The shroud assembly of claim 15, further comprising the gap having a maximum dimension selected to control a level of stress developed in the ceramic matrix composite member when the ceramic matrix composite member is impacted by the rotating blade tip.

17. The shroud assembly of claim 15, wherein the metal support member is selected to provide a predetermined resistance to further deflection of the ceramic matrix composite member when the ceramic matrix composite member is deflected to reduce the gap to zero.

18. The shroud assembly of claim 15, wherein the ceramic matrix composite member comprises a material exhibiting a thermal conductivity characteristic of no mare than 4 watts/meter-° K at a predetermined operating temperature.

19. A shroud assembly for sealing a cavity extending radially outward from a rotating blade tip to a blade ring of a combustion turbine engine to isolate the cavity from a combustion gas flowing past the blade tip, the shroud assembly comprising:

a ceramic matrix composite member comprising a radially inner surface for wearing contact with the rotating blade tip and defining a primary pressure boundary for the combustion gas;

a support member supporting the ceramic matrix composite member apart from the blade ring and comprising a radially inner surface separated from a radially outer surface of the ceramic matrix composite member by a gap, the radially inner surface of the support member defining a secondary pressure boundary for the combustion gas in the event of failure of the ceramic matrix composite member; and the gap having a dimension sufficiently small to limit resonance of fluid surrounding the rotating blade tip in the event of failure of the ceramic matrix composite member.

20. The shroud assembly of claim 19, further comprising the gap having a maximum dimension selected to control a level of stress developed in the ceramic matrix composite member to a predetermined value when the ceramic matrix composite member is deflected to impact the support member by an impact with the rotating blade tip.

21. The shroud assembly of claim 19, wherein the support member is selected to provide a predetermined resistance to further deflection of the ceramic matrix composite member when the ceramic matrix composite member is deflected to reduce the gap to zero.

* * * * *